US009617934B2

(12) United States Patent
Remele et al.

(10) Patent No.: US 9,617,934 B2
(45) Date of Patent: Apr. 11, 2017

(54) METHOD FOR TORQUE CONTROL OF AN INTERNAL COMBUSTION ENGINE, AND INTERNAL COMBUSTION ENGINE

(71) Applicant: MTU Friedrichshafen GmbH, Friedrichshafen (DE)

(72) Inventors: Jörg Remele, Hagnau (DE); Aron Toth, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 117 days.

(21) Appl. No.: 14/683,751

(22) Filed: Apr. 10, 2015

(65) Prior Publication Data

US 2015/0211426 A1 Jul. 30, 2015

Related U.S. Application Data

(63) Continuation of application No. PCT/EP2013/002996, filed on Oct. 4, 2013.

(30) Foreign Application Priority Data

Oct. 10, 2012 (DE) ..... 10 2012 020 488

(51) Int. Cl.
*F02D 41/00* (2006.01)
*F02D 41/14* (2006.01)
(Continued)

(52) U.S. Cl.
CPC ..... *F02D 41/0085* (2013.01); *F02B 75/22* (2013.01); *F02D 35/023* (2013.01);
(Continued)

(58) Field of Classification Search
CPC .. F02D 41/00; F02D 41/0085; F02D 41/3094; F02D 41/1443; F02D 41/009;
(Continued)

(56) References Cited

U.S. PATENT DOCUMENTS 5,131,371 A 7/1992 Wahl et al.
6,820,593 B2 11/2004 Remele et al.
(Continued)

FOREIGN PATENT DOCUMENTS

DE 10 2004 055 313 A1 5/2006
DE 10 2010 051 369 A1 5/2012
DE 10 2010 051 370 A1 5/2012
FR 2 950 655 A1 4/2011

OTHER PUBLICATIONS

International Search Report dated Feb. 26, 2014 for International Application No. PCT/EP2013/002996 (6 pages).

*Primary Examiner* — Hieu T Vo
(74) *Attorney, Agent, or Firm* — Taylor IP, P.C.

(57) ABSTRACT

A method for torque control of an internal combustion engine includes a pressure sensor that is associated with at least one, but at the most two cylinders of the internal combustion engine, whereby an cylinder internal pressure for the cylinder associated with the pressure sensor is detected. The method carries out an adjustment of injection characteristics for the injectors allocated to the individual cylinders of the internal combustion engine by way of a method which is independent from the detected cylinder pressure. A torque control for the internal combustion engine is performed based on the detected cylinder pressure.

10 Claims, 1 Drawing Sheet

(51) Int. Cl.

| | |
|---|---|
| ***F02D 41/24*** | (2006.01) |
| ***F02D 35/02*** | (2006.01) |
| ***F02B 75/22*** | (2006.01) |
| ***F02D 41/30*** | (2006.01) |

(52) U.S. Cl.
CPC ..... *F02D 41/009* (2013.01); *F02D 41/1443* (2013.01); *F02D 41/1486* (2013.01); *F02D 41/1497* (2013.01); *F02D 41/2467* (2013.01); *F02D 41/3094* (2013.01); *F02D 2200/101* (2013.01); *F02D 2200/1004* (2013.01); *F02D 2250/18* (2013.01)

(58) Field of Classification Search
CPC ..... F02D 41/1486; F02D 35/023; F02D 2200/101
See application file for complete search history.

(56) References Cited

U.S. PATENT DOCUMENTS

| | | | | |
|---|---|---|---|---|
| 7,128,051 | B2 * | 10/2006 | Nogi | F01L 9/04 123/336 |
| 7,726,281 | B2 * | 6/2010 | Buslepp | F02D 35/023 123/406.22 |
| 9,371,813 | B2 * | 6/2016 | Okamoto | F02D 41/065 |
| 2009/0043475 | A1 | 2/2009 | Buslepp et al. | |
| 2010/0063711 | A1 | 3/2010 | Hagel et al. | |
| 2016/0138512 | A1 * | 5/2016 | Choi | F02D 41/3035 123/306 |

* cited by examiner

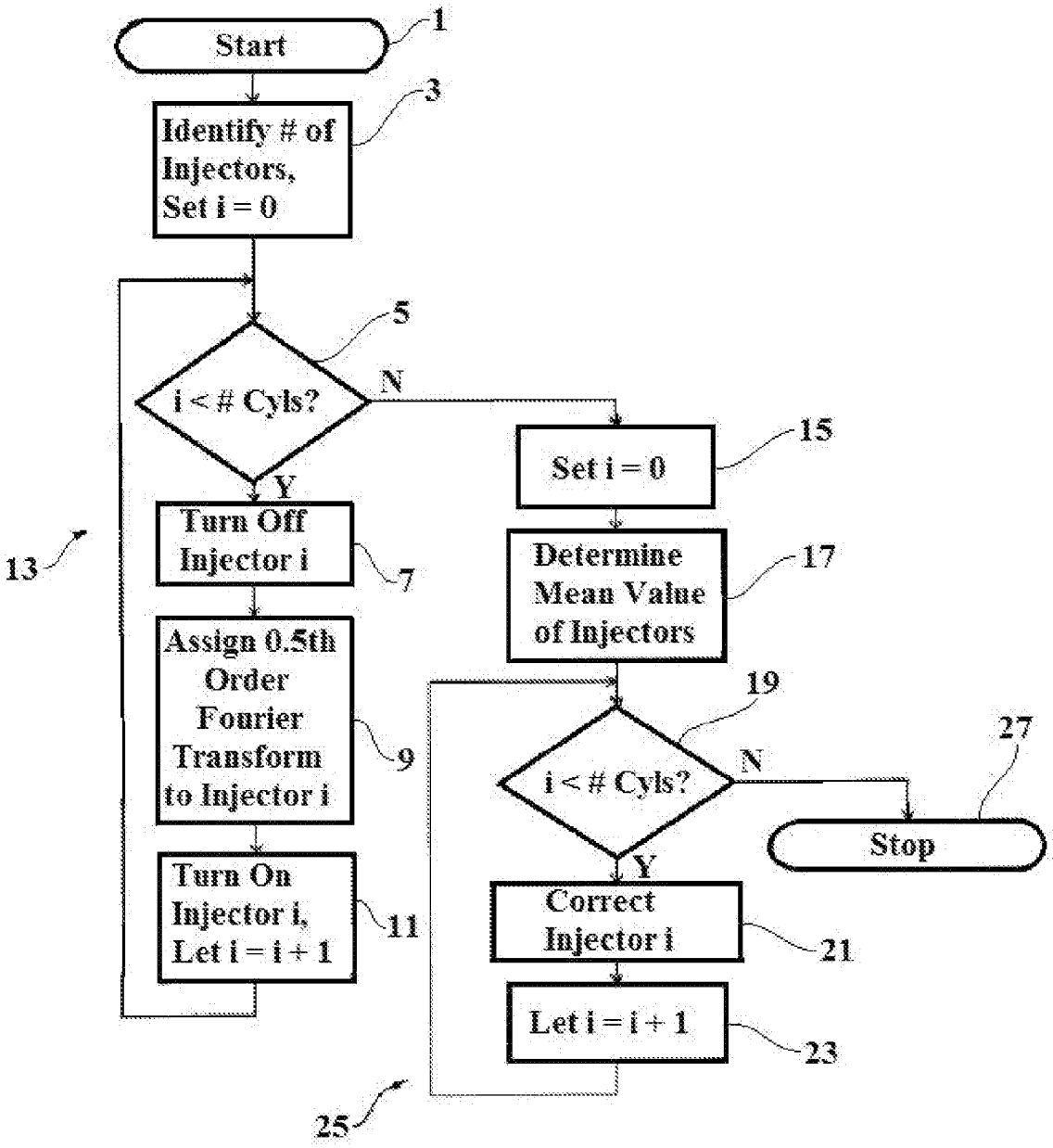
Start
1
Identify # of Injectors, Set i = 0
3
i < # Cyls?
5
N
Y
Turn Off Injector i
7
Assign 0.5th Order Fourier Transform to Injector i
9
Turn On Injector i, Let i = i + 1
11
13
Set i = 0
15
Determine Mean Value of Injectors
17
i < # Cyls?
19
N
Y
Stop
27
Correct Injector i
21
Let i = i + 1
23
25

METHOD FOR TORQUE CONTROL OF AN INTERNAL COMBUSTION ENGINE, AND INTERNAL COMBUSTION ENGINE

CROSS REFERENCE TO RELATED APPLICATIONS

This is a continuation of PCT application No. PCT/EP2013/002996, entitled "METHOD FOR TORQUE CONTROL OF AN INTERNAL COMBUSTION ENGINE, AND INTERNAL COMBUSTION ENGINE", filed Oct. 4, 2013, which is incorporated herein by reference.

BACKGROUND OF THE INVENTION

1. Field of the Invention

The invention relates to a method for torque control of an internal combustion engine and to an internal combustion engine employing the method.

2. Description of the Related Art

Methods for torque control of internal combustion engines are known in the prior art. A method is known from German disclosure document DE 10 2010 051 370 A1, wherein with the assistance of a pressure sensor an internal cylinder pressure is determined in a guide cylinder. From the speed information a first torque is determined for each cylinder of the internal combustion engine, whereas a second torque is determined from the internal cylinder pressure which was recorded for the guide cylinder. Based on the respective first torque and a second torque an indexed torque is determined for each cylinder. A preferred embodiment provides that the second torque which is determined for the guide cylinder is used for quality assessment of the determined first torques. The reference determines a functional efficiency of the pressure detector via the first torques and provides a simple diagnostic option. The amount of fuel injected for the individual cylinders depends upon the indexed torque of each cylinder which is determined with the assistance of the respective first torque or respectively the second torque. With this method, injection control and torque control are tightly interrelated and in particular the second torque that was determined for the guide cylinder is regularly compared and/or balanced with the first torques which were determined based on the speed information. This renders the method unduly complicated. Furthermore, one cannot assume that the second torque that was determined for the guide cylinder on the basis of the pressure measurement is characteristic for the entire internal combustion engine.

An underlying problem is that injectors for injecting fuel into cylinders of an internal combustion engine, for identical control, in particular in energizing, display manufacturing related variances in their opening behavior. If the injectors of the internal combustion engine are controlled with identical energizing parameters, in particular with an identical energizing duration, they nevertheless inject different fuel amounts into the individual cylinders. With low injection amounts the variance is so large that some injectors inject fuel into the cylinders that are assigned to them, whereas others do not open. Pre-injection and after-injection are therefore not realizable if the injectors vary strongly. Moreover, the individual cylinder pressure values differ greatly among each other and the cylinders differ greatly from one another in regard to the torques produced by them. If therefore, the injectors are not adjusted or respectively equalized in regard to their injection behavior, a pressure sensor has to be assigned to each cylinder for torque control, because no single cylinder pressure can be characteristic for the entire combustion engine. Overall it is therefore desirable to reliably reduce the variance in the opening behavior of the injectors in operation of the internal combustion engine.

SUMMARY OF THE INVENTION

The present invention provides a way to decouple an injection control for equalization of the injectors in an internal combustion engine from a torque regulator, so that both controls can be performed in a simple manner independent of each other. One internal cylinder pressure that was determined for one or at most for two cylinders then becomes characteristic for the entire internal combustion engine or at least for a cylinder bank, so that a torque control can occur solely on the basis of this pressure, without the use of additional parameters. The present invention provides an internal combustion engine in which all aforementioned advantages are realized.

A method for torque control of an internal combustion engine according to an embodiment of the present invention provides that a pressure sensor is assigned to at least one cylinder, and at most to two cylinders, of the internal combustion engine, whereby an internal cylinder pressure for the cylinder that is assigned to the pressure sensor is detected by way of the pressure sensor. Therefore only two pressure values at most are detected for two cylinders at most, it being possible that only one pressure value is detected for only one cylinder. The method has injectors which are assigned to the individual cylinders of the internal combustion engine that are adjusted to be equal in regard to their injection behavior by way of a method which is independent from the detected cylinder pressure or respectively the detected cylinder pressure values. The method which equalizes the injection behavior of different injectors does therefore not rely on the assistance of values that were captured by the at least one pressure sensor. Rather, the torque control for the internal combustion engine is implemented on the basis of the detected cylinder pressure. It is therefore possible not to rely on values or parameters detected within the scope of the method used for injector equalization. The equalization of the injectors in regard to their injection behavior on the one hand and the torque control on the other hand are therefore largely independent from each other, thereby simplifying the method compared to the known methods. Due to the fact that the injectors display identical injection behavior with the assistance of the method for their equalization, at least to a practically relevant extent the at least one detected cylinder pressure is characteristic also for the entire internal combustion engine, so that in particular a global torque of same can be readily controlled by referring to the at least one or respectively the at least two detected pressure values.

A method according to another embodiment of the invention is provided, which implemented in a V-engine, whereby the V-engine has two V-shaped cylinder banks arranged at an angle relative to each other. In each cylinder bank one pressure sensor is assigned to precisely one cylinder. No pressure sensor is assigned to the remaining cylinders in the cylinder bank. The internal combustion engine therefore has only a total of two pressure sensors, each of which detects a cylinder pressure that is typical for the respective cylinder bank. This enables a torque control which is carried out virtually individually for each cylinder, in other words relative to one cylinder bank. Within the scope of the method it is also possible that the injectors within one cylinder bank are equalized with each other, whereby equalization between the two cylinder banks does not necessarily occur. In this case only the cylinder pressure value detected for one cylinder bank is typical for only that bank, because the injectors which are assigned to the cylinders of the other cylinder bank are indeed equalized among each other, but not with the cylinders of the one cylinder bank. In another embodiment of the method it is however possible, to collectively equalize the injectors of the V-engine, whereby each of the cylinder pressure values detected for the two cylinder banks is typical for the entire internal combustion engine. In this respect a redundancy is then created and errors occurring in one pressure measurement or even a failure of a pressure sensor can possibly be corrected and/or compensated for by the other pressure measurement or respectively the other pressure sensor.

A method according to another embodiment of the invention uses precisely one and only one pressure sensor. In this embodiment of the method only one single pressure sensor is accordingly provided on one single cylinder. Torque control for the engine is nevertheless possible because the injectors of the internal combustion engine are equalized among each other, so that the cylinder pressure value detected for the one cylinder is typical for the entire internal combustion engine, thus the cylinder pressure values in the other cylinders coincide with the pressure value detected for the one cylinder, at least to a practically relevant extent. An advantage of this method is that the injection behavior of the injectors is reliably adjusted or respectively equalized.

In another embodiment of the invention, injector equalization is implemented with the assistance of a method that is independent of the pressure value, including the following steps: Initially, a first injector is first turned off. A crank angle signal of the internal combustion engine is detected and transformed into the frequency range by way of discrete Fourier transformation. From the discrete Fourier transformation results in particular an amount and an angle of the harmonic of the $0.5^{th}$ order, whereby within the scope of the method only the amount is captured and stored. The amount is assigned to the only injector that is turned off during the capture. Afterwards the turned off injector is again turned on. These steps are implemented sequentially one after another for all injectors of the internal combustion engine, so that during each step always only one injector is turned off. The amounts captured in the various steps are therefore always clearly assignable to one turned off injector. After an amount of the harmonic of the $0.5^{th}$ order of the Fourier transformation of the crank angle signals has been captured, stored and assigned for each injector, all of the stored amounts assigned to the individual injectors are averaged. Control of the injectors is now corrected on the basis of a deviation from the mean value of the amount assigned to an injector that is to be corrected. This means that for each injector a difference between the amount assigned to it and the mean value is calculated, whereby this difference or deviation represents a measure for the correction of the control of the injector.

In this way a type of regression to the mean value is implemented for virtually all injectors. Their injection performance is thus adjusted so that the measured amount of the harmonic of the $0.5^{th}$ order of the Fourier transformation of the crank signal is approximated to the mean value of all injectors. A comparison of the injection performance of the individual injectors, by way of the amount of the harmonic of the $0.5^{th}$ order, with an average injection performance is continuously performed. Because of this continuously performed individual comparison, while turning off individual injectors, with the actual mean value it is possible to forgo having to consider contributions of a higher order and to limit consideration to the $0.5^{th}$ order. A precise adjustment of the injector performance of the individual injectors is possible, so that all injectors inject approximately the same amount of fuel. It becomes also possible to achieve or respectively realize a pre-injection and/or an after-injection. A pre-injection is advantageous because a softer combustion sequence, as well as a reduction of the nitrogen oxide formation is thereby feasible. An after-injection leads to a temperature increase of the exhaust gas, which is advantageous for downstream exhaust gas treatment. The described injector equalization is so reliable that cylinder pressure values in the individual cylinders, at least to a relevant extent, correspond so that it is essentially sufficient to capture a single cylinder pressure value that is characteristic for the entire combustion engine. A torque control can readily be based on this.

The method may be implemented by way of an engine control unit, whereby the crank angle signal, in other words a rotational speed progression of the crank shaft over the crank angle, is detected possibly by a crank shaft sensor and transmitted to the engine control unit. A crankshaft sensor is usually provided in modern internal combustion engines, and an engine control unit is also usually included. To implement the method therefore, only components are used which are already included in the internal combustion engine. Therefore, no additional costs occur in the implementation of the method for sensors, devices and/or wiring. The algorithm for execution of the method may be implemented into the engine control unit. Also, the at least one pressure sensor may be operatively connected with the engine control unit and controlled and/or read by same. Accordingly the torque control or respectively the algorithm for this is also implemented into the engine control unit.

The engine control unit may be synchronized through the signal of a cam shaft sensor to operating cycles of the cylinder of the internal combustion engine. This can occur one single time after or during the start of the internal combustion engine, or also continuously. A cam shaft sensor is normally also included in an internal combustion engine, and a synchronization of the engine control unit with the operating cycles of the cylinders occurs also in normal engine control. In this respect, no additional expenditure occurs due to the method.

In one embodiment of the invention, a correction for an injector is only made if the deviation of the detected and stored amount of the harmonic of the $0.5^{th}$ order of the Fourier transformation of the crank angle signal exceeds a predetermined threshold value which was determined from a mean value of all injectors. This approach is based on the concept that not every deviation from the mean value is relevant in practice, particularly when such deviation is small. Therefore, in order to keep the injector equalization efficient, a threshold value can meaningfully be determined, whereby if said threshold value is exceeded by a deviation that is assigned to one injector, a correction is to actually occur. Therefore, it is first determined for each injector if the deviation exceeds the predetermined threshold value and only if this is the case the correction in controlling this injector is in fact implemented.

A method is also provided wherein for each injector a differential amount is calculated as a difference from the amount assigned to the injector which is detected and stored when all injectors are turned on, whereby the differential amounts assigned to the individual injectors are used as basis for averaging and also the correction. This approach is based on the concept that the amount of the harmonic of the $0.5^{th}$ order of the Fourier transformation of the crank angle signal, in the event that all injectors are turned on and the internal combustion engine is therefore operating normally, does not necessarily disappear or at least is near zero. If an amount that is clearly different from zero can be detected for the normally operating internal combustion engine, all amounts measured for the individual turned off injectors may be referenced to this amount, in that their differences from this amount are calculated and considered for the further process. Moreover, the creation of a mean value relates then to the thus calculated differential amounts and the correction in the control of the injectors is implemented accordingly on the basis of the deviations of the differential amounts from this created mean value. The differences are hereby typically signed, in other words are not absolute values in a strict mathematical sense.

It is thereby possible that the amount serving as reference point for the amounts assigned to the individual injectors is measured during normal operation of the internal combustion engine, and is captured and stored once, for example after a start of the internal combustion engine. It is however also possible to capture and store this amount in predetermined time intervals or continuously whenever no injector is turned off. In such a case, a value stored in a database is always replaced by a current, newly captured value.

It is evident therefore that the method may not be implemented on the basis of absolute amounts, but rather on the basis of the differential amounts relative to the amount of the harmonic of the $0.5^{th}$ order at normal running engine which serves as the reference point if this amount, in other words the reference point is different from zero, at least in the relevant extent. If this is not the case, and the amount is zero or at least near zero the method can be implemented on the basis of the absolute amounts that were collected and stored for the injectors, without creating differentials. It is however also possible to implement the method in this case on the basis of the differential amounts, in particular since there is no difference in the result compared with the method without difference creation if the amount is zero with a normally running engine. The differences are after all "amounts."

Two iterations of the method may be conducted. The method may be iterated, in other words conducted sequentially one after another; until the deviation of each injector from the mean value created for each injector no longer exceeds the predetermined threshold value. The method may be repeated until the deviation from the mean value for all injectors is less than the predetermined threshold value. This ensures that, at least to a practically relevant extent, that in fact all injectors inject substantially the same fuel amount. A practical relevant range can be determined by definition of the predetermined threshold values.

Activation of the injectors may be corrected in such a way that during the correction an overall performance of the internal combustion engine is not changed. This means that the injectors are corrected to compensate for each other. If the amount of fuel injected by a first injector is increased, then the amount of fuel injected by a second injector, or also the amount of fuel injected by several other injectors may accordingly be reduced, so that altogether the overall efficiency of the internal combustion engine is not changed. The injector equalization which is conducted using the method therefore, may not lead to a change of the current load point of the internal combustion engine. The method particularly avoids sudden accelerations or decelerations of the internal combustion engine. It is thereby possible that this characteristic further is ensured outside of the method in that for example a torque control is superimposed over the method. It is however also possible to provide this characteristic within the method by considering such compensation inherently necessary during the correction of the control of the individual injectors.

A method is moreover provided in which control of the injectors is corrected, such that an energizing duration for same is adjusted. The energizing duration of an individual injector is thereby changed so that the desired correction of the injected fuel amount is achieved. The energizing duration may for example be extended if the injector is to inject more fuel. It can be shortened, if the injector is to inject less fuel.

A method is also provided in which the energizing duration for an injector is adjusted in that an energizing duration differential is added onto the current energizing duration which is calculated according to the following equation:

$$\Delta BD[i]=(MW-\Delta\text{amount}[i])K \quad (1)$$

i is hereby a running variable which runs across the individual injectors and whose value always indicates an actual observed injector. ΔBD[i] signifies the energizing duration difference which is to be added onto the actual energizing duration for injector i. This means adding the positive or negative energizing duration difference to the actual current energizing duration. Δamount[i] is the accordingly determined differential amount for injector i. MW is the mean value which is calculated from the differential amounts of the amounts of the harmonic of the $0.5^{th}$ order that are assigned to the individual injectors of the running engine, in other words from the captured and stored amounts when all injectors are turned on. MW is the mean value, in other words the value formed from the individual differential amounts Δamount[i] of all injectors. K is a constant which is selected so that a suitable correction of the energizing duration is possible.

It may already be ensured during the correction of the energizing duration that the overall performance of the internal combustion engine is not changed during the correction. This is ensured in that the specified equation (1) is applied preferably under the following conditions.

$$\Sigma\Delta BD[i]=0 \quad (2)$$

Σ is hereby the summation symbol and the running variable i applies to all injectors. During calculation of the energizing duration for the individual injectors it is to be ensured that their sum over all injectors always results in 0. If therefore, certain energizing durations are increased, then other energizing durations must be accordingly decreased, so that overall the summation condition remains fulfilled and the individual energizing differences cancel each other out.

Constant K is selected possibly dependent upon a current load point of the internal combustion engine. A table with the values for constant K that are assigned to various load points of the internal combustion engine may be stored in a memory of the engine control unit. Depending on the current load point of the internal combustion engine, the appropriate value for constant K is then used for implementation of the method.

The method may be performed at an operating point of the internal combustion engine wherein it operates under load or no-load. The method is in particular readily applicable under such operating conditions. With larger engines, for example engines that drive generators, engines for diesel locomotives or ships, or similar, in particular multi-cylinder large engines, a thrust phase as is known from the operation of a conventional motor vehicle, generally does not exist. In this instance the term "thrust phase" is understood to be an operational condition of the internal combustion engine wherein it is dragged along by a rolling vehicle. Large engines in contrast operate only under load or no-load. Diverse methods are known whose functionality in regard to injector equalization and/or torque control is based on implementation during a thrust phase of a motor vehicle. Accordingly, these methods are not applicable for large engines, which generally have no thrust phase. Therefore, the herein proposed method is especially suitable for large engines. The special suitability of the method for large engines results from the fact that it can readily be performed at an operating point of the internal combustion engine under load or in neutral.

The invention may also include an engine control unit which is configured to perform the method according to one of the previously described embodiments. This means in particular that an algorithm to perform the method is implemented within the engine control unit. Moreover, a connection of a crankshaft sensor to the engine control unit may be provided, so that the crankshaft sensor can detect and further process a crank angle signal according to the method. Moreover, interfaces are advantageously provided on the engine control unit for connection to the individual injectors of the internal combustion engine, so that they can be energized as well as individually turned on and off by the engine control unit. The engine control unit may moreover be operatively connected with the at least one pressure sensor, so that it can be controlled and/or read out. Therefore, at least one interface is preferably provided for connection to the at least one pressure sensor. Moreover, an algorithm to perform the injector equalization and torque control, in other words, to altogether perform the method, may be implemented within the engine control unit.

The invention also provides a system for adjustment of an injection performance of injectors and for torque control. The system implements a method according to one of the previously described embodiments. The system includes a switching device, with the assistance of which the individual injectors can be turned on and off selectively. It moreover includes a detection device which is designed so that a crank shaft angle signal of the internal combustion engine can be captured. The detection device may be designed as a crank shaft sensor. The detection device is operatively connected with a converter, so that the crank angle signal that is captured by the detection device can be transmitted to the converter. The converter is designed so that with its assistance the crank angle signal can be converted into the frequency range by way of discrete Fourier transformation. A memory device is also provided so that with its assistance an amount of the harmonic of the $0.5^{th}$ order of the Fourier transformation of the crank angle signal can be captured and stored. For this purpose the converter and the memory device may be operatively connected. The memory device is moreover designed so that it can assign the captured and stored amount to an injector that was turned off during capturing and saving of the amount. Moreover, an averaging element is provided which is designed so that with its assistance a mean value for all injectors of the amounts stored in the memory device can be calculated. In addition a correction element is provided that is designed so that with its assistance a deviation from the mean value of an amount assigned to an injector that is to be corrected can be calculated, whereby control of the injector by way of the calculated deviation can be corrected.

The system moreover includes at least one pressure sensor, but at most two pressure sensors for the capture of an internal cylinder pressure of the internal combustion engine. A torque control unit is provided which, with the assistance of the at least one captured internal cylinder pressure performs a torque control for the internal combustion engine. The torque control unit may operate independently from the components of the system which serve to equalize the injectors. In reverse, the elements of the system which serve to equalize the injectors also work independently from the torque control unit. The corresponding system components operate therefore independent of each other without falling back on the parameters and/or values which were captured by the other system components respectively. An efficient and plausible torque control can however occur nevertheless, because due to the reliable equalization of the injection behavior of the injectors the internal cylinder pressure captured by the at least one pressure sensor is characteristic for the entire internal combustion engine.

The system may include an engine control unit, in particular an engine control unit according to the previously described embodiment. The engine control unit may include the switching device, the converter, the memory device, the averaging element, the correction element and the torque control unit.

A system is provided, which may also be included in the engine control unit, incorporating the creation of differentials by way of which for each injector a differential amount can be calculated as a difference between the amount assigned to one injector and an amount which is captured and stored when all injectors are turned on. Of course, a detection and memory device may also be provided for the amount which is captured and stored when the engine is running normally. In this case the system may be designed so that the differential amounts assigned to the individual injectors are based on the mean value creation and the correction.

Also in other respects, the system may be designed so that the embodiments described as within the scope of the method can be implemented by the system. The system is in particular designed so that the energizing duration for the injectors can be adjusted through the energizing differentials, which are calculated according to the previously described equation (1), whereby the previously described conditions (2) can at the same time be maintained, in order to ensure that the overall performance of the internal combustion engine is not changed by the injector equalization. Appropriate ways of implementing the adjustment of the energizing duration according to the specified equation (1) and according to the specified conditions (2) may be provided in the engine control unit.

The invention provides an internal combustion engine including a plurality of cylinders, whereby a pressure sensor is assigned to at least one, at most however to two cylinders. The internal combustion engine includes moreover an engine control unit. The engine control unit is equipped for the implementation of a method according to one of the previously described embodiments. In particular, an algorithm is accordingly implemented within the engine control unit with the assistance of which the previously described method can be performed. The engine control unit moreover may include the interfaces and components which are necessary for controlling and/or reading the at least one pressure sensor, camshaft signal, crankshaft signal and the individual injectors. The engine control unit may thus be designed according to one or another of the previously described embodiments. With the internal combustion engine it is sufficient to capture one single cylinder pressure value, since this is characteristic for the entire internal combustion engine due to the equalization of the injectors. Nevertheless it is possible in another embodiment to capture two cylinder pressure values by way of two cylinder pressure sensors.

An internal combustion engine may be designed as a V-engine, including two V-shaped cylinder banks arranged at an angle relative to each other. Each cylinder bank includes precisely one cylinder to which a pressure sensor is assigned. No pressure sensor is assigned to the remaining cylinders. For this reason a characteristic internal pressure value can be captured for each cylinder bank. The torque control, if necessary, can be performed for individual cylinders banks or for redundancy, depending on whether, as previously described, the individual injectors are equalized collectively for the entire internal combustion engine or only including the individual cylinder banks.

Finally, an internal combustion engine is provided having a pressure sensor assigned to precisely one and only one cylinder of the internal combustion engine. In this case the internal combustion engine includes in fact one single pressure sensor, so that only one single internal cylinder pressure value of one single cylinder can be captured. The remaining cylinders do not include a cylinder pressure sensor, so that no internal cylinder pressure value can be captured relating to these cylinders. It is basically sufficient for torque control of the internal combustion engine to capture one single internal cylinder pressure value for one single cylinder, because the injectors which are assigned to the cylinders are equalized with each other in regard to the injection performance, so that the injected fuel amount, at least in practically relevant range, are identical. As a result, the internal cylinder pressure values of the individual cylinders, at least in practically relevant range, do not differ from each other. In this way, a global torque control for the internal combustion engine can virtually be realized with the assistance of a single pressure sensor, whereby within the scope of the torque control one does not have to rely on otherwise captured parameters or values.

Overall it is therefore possible within the scope of the method and in the internal combustion engine to minimize a variance between the cylinders. This, in particular, opens up the possibility to bring peak pressures of the cylinders closer to a maximum permissible limit, thus achieving an overall greater efficiency for the engine. There is no danger of damaging the engine permanently since it is ensured that individual internal cylinder pressures do not exceed a predefined maximum limit. If, however the injectors were not reliably equalized, exceeding the maximum permissible pressure in individual cylinders whose internal pressure is not captured could occur, whereby the engine could possibly be damaged. In the same manner, a clutch is also protected from damage or destruction, thus allowing simpler and more cost effective design. The method and the internal combustion engine overall are cost effective, because a very small number of pressure sensors are provided, namely two at most, and possibly only one.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein:

FIG. 1 illustrates a flow chart showing one embodiment of the method for injector equalization.

Corresponding reference characters indicate corresponding parts throughout the several views. The exemplification set out herein illustrates one embodiment of the invention and such exemplification is not to be construed as limiting the scope of the invention in any manner.

DETAILED DESCRIPTION OF THE INVENTION

Referring now to FIG. 1, the method starts in step 1, after which in step 3 a number of the cylinders of the internal combustion engine is initially identified. The embodiment of the method illustrated in the drawing provides that exactly one injector is assigned to each cylinder. Therefore, the number of cylinders is consistent with the number of injectors. It is nevertheless possible in another embodiment of the method that the internal combustion engine includes more than one injector per cylinder. In this case, the number of injectors may be identified in step 3, not the number of cylinders. In step 3 a running variable i is also defined and initialized, whereby it may be assigned value of 0.

In a retrieval step 5, the current value of the running variable i is compared with the number of cylinders that are identified in step 3. For the sake of illustration, it is assumed that the running variable is initialized with a value of 0, so that value 0 of running variable i is also assigned to the first injector for which the method is performed. In another embodiment, the running variable may be initialized with another value, for example value 1. Accordingly, in retrieval step 5, if running variable i is initialized with value 0, it is verified whether the value of the running variable is less than the number of cylinders identified in step 3. If this is the case, the method proceeds to a step 7 where the injector to which the current value of running variable i is assigned is turned off.

Subsequently in step 9 an amount or differential amount of the harmonic of the $0.5^{th}$ order of the Fourier transformation of the crank angle signal is captured and stored and assigned to the turned off injector. In step 11 the value of running variable i is increased by one. At the same time, the turned off injector is turned on again. The method returns then to retrieval step 5 where it is again verified whether the now current value of running variable i is still less than the number of cylinders. In this manner a loop 13 is cycled a number of times until an amount or differential amount has been captured for all injectors in step 9, sequentially one after the other. A value of running variable i that is consistent with the number of cylinders reduced by one is thereby assigned to the last injector. Therefore, after capture of the amount or differential amount for the last injector in step 9, the value of the running variable is increased to a value which is consistent with the number of cylinders. If this is detected in retrieval step 5 the method proceeds on to step 15.

Here, the value of running variable i is again initialized, and in particular with the herein discussed embodiment of the method set to 0. In a subsequent step 17 a mean value is created from the captured and stored amounts or differential amounts for the individual injectors. The method subsequently enters into retrieval step 19 where it is again verified whether the actual value of running variable i is less than the number of cylinders identified in step 3. If this is the case the method proceeds to step 21 where a correction in the control of the injector to which the current value of running variable i is assigned is performed. This may occur on the basis of a differential amount relating to an amount determined for the normal operation of the internal combustion engine assigned to the only turned off injector, as well as on the basis of a mean value of the differential amounts for the individual injectors. An energizing duration for the injector may be adjusted, whereby an energizing duration difference is added to the actual current energizing duration. The energizing duration difference may thereby be calculated according to the aforementioned equation (1), and applied according to the aforementioned conditions (2).

In subsequent step 23 the value of running variable i is again increased by one. The method then reverts to retrieval step 19, so that a loop 25 is realized. This loop is again cycled through until a correction has been performed for all injectors, or respectively until the value of running variable i in retrieval step 19 is consistent for the first time with the number of cylinders identified in step 3. This is because in the selected embodiment of the method, wherein running variable i is initialized with 0, a value is assigned to the last injector that is to be corrected which, compared to the number of cylinders is reduced by one. If, in retrieval step 19 the value of running variable i is for the first time identical to the number of cylinders identified in step 3, then the method concludes in a step 27. The correction of the energizing duration in step 21 for the cylinder to which the current value of running variable i is assigned is preferably only performed if a deviation of the amount or a differential amount from the median value exceeds a predetermined threshold value. Otherwise no correction for the injector is performed and the method proceeds to step 23.

The process may be iterated, in other words returns, if applicable after a predefined waiting period, from step 27 to step 1, wherein this iteration or respectively a loop provided between steps 27 and 1 which is not shown in the drawing is cycled until the deviations of the individual amounts or differential amounts for the individual injectors from the mean value are smaller than a predefined threshold value. It is hereby possible that this threshold value is identical to the threshold value which is selected for the decision whether a correction of an individual injector is to be performed. It is however also possible, as a condition to stop iteration of the entire process, to provide a threshold value that deviates from this threshold value which can be larger or smaller than the threshold value for the correction of the individual injectors.

Overall it is shown that with the assistance of the method for injector equalization, a very precise equalization of injectors, in particular in larger engines and especially during running operation under load or no-load operation, is readily possible, so that the individual injectors inject substantially the same amount of fuel. For this reason pre-injection and/or after-injection are also possible in the internal combustion engine. In regard to torque control it has been shown that this can be performed simply and cost effectively, in that at most two, and possible only one cylinder pressure sensor is used. Due to the reliable equalization of the injectors it is possible to bring peak pressures of the cylinders closer to a maximum permissible limit, resulting in greater engine efficiency without the risk of damaging the engine. This has a positive effect on the life span of the internal combustion engine. In torque adjustment a torque of the internal combustion engine is determined preferably on the basis of the captured internal cylinder pressure. This is compared with a load-point dependent predefined target torque and adjusted by way of a control algorithm, by increasing the fuel amounts injected by the injectors if the actual torque deviates downward from the target torque, and whereby the injected fuel amounts are decreased if the actual torque deviates upward from the desired target torque. In doing so, the target torques for the internal combustion engine are recorded in a characteristic diagram for all load points.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine having a plurality of cylinders, wherein:

at least one pressure sensor is assigned to between one and two of said plurality of cylinders;

said internal combustion engine having an engine control unit, said engine control unit implementing a series of steps, said series of steps comprising:

detecting an internal cylinder pressure for said between one and two cylinders of said internal combustion engine using said at least one pressure sensor;

adjusting a number of injectors assigned to a number of said plurality of cylinders of said internal combustion engine to be equal in regard to their injection behavior independently from said detected internal cylinder pressure; and performing a torque control of said internal combustion engine on the basis of said detected internal cylinder pressure.

2. The internal combustion engine according to claim 1, wherein:

said internal combustion engine is designed as a V-engine, having two V-shaped cylinder banks arranged at an angle relative to each other, each cylinder bank including precisely one cylinder to which a pressure sensor is assigned.

3. The internal combustion engine according to claim 1, wherein:

a pressure sensor is assigned to precisely one cylinder of said internal combustion engine.

4. A method for torque control of an internal combustion engine, including the steps of:

assigning at least one pressure sensor to between one and two cylinders of said internal combustion engine;

detecting an internal cylinder pressure for said between one and two cylinders of said internal combustion engine using said at least one pressure sensor;

adjusting a number of injectors assigned to a number of cylinders of said internal combustion engine to be equal in regard to their injection behavior independently from said detected internal cylinder pressure; and performing a torque control of said internal combustion engine on the basis of said detected internal cylinder pressure.

5. The method according to claim 4, wherein:

said internal combustion engine being a V-engine, said V-engine having two cylinder banks arranged at an angle relative to each other, each of said cylinder banks having exactly one cylinder to which one pressure sensor is assigned.

6. The method according to claim 4, wherein:

exactly one pressure sensor is used.

7. The method according to claim 4, wherein:

said step of adjusting a number of injectors assigned to a number of cylinders of said internal combustion engine to be equal in regard to their injection behavior further comprises the sub-steps of:

turning off one of said number of injectors;

capturing a crank angle signal from said internal combustion engine;

converting said crank angle signal into a frequency range using a discrete Fourier transformation;

capturing and storing an amount of a harmonic of the 0.5th order of said Fourier transformation of said crank angle signal;

assigning said amount to said turned off injector;

turning on said turned off injector;

performing each previous sub-step in a sequential manner for each injector of said internal combustion engine;

creating a mean value of said stored amounts over all of said injectors; and correcting a control of said injectors based on a deviation of said amount from said mean value assigned to an injector that is to be corrected.

8. The method according to claim 4, further comprising the steps of:

calculating for each said injector a differential amount as a difference from an amount assigned to each said injector which is detected and stored when all of said injectors are turned on and an amount when said injector is turned off; and using said differential amounts assigned to each said injector as basis for creating a mean value and also for a correction.

9. The method according to claim 4, wherein:

control of said number of injectors is corrected, in that an energizing duration for each of said number of injectors is adjusted.

10. The method according to claim 9, wherein:

said energizing duration for each of said number of injectors is adjusted such that an energizing duration differential is added onto a current energizing duration, said energizing duration differential being calculated according to the following formula:

$\Delta BD[i]=(MW-\Delta\text{amount}[i])*K$, wherein:

ΔBD[i] signifies said energizing duration differential for an injector [i];

MW signifies a mean value calculated from differential amounts between amounts of a harmonic of the 0.5th order that are assigned to each of said number of injectors;

Δamount[i] is a determined differential amount for injector [i]; and

K is a constant;

said formula being used under condition $\Sigma\Delta BD[i]=0$.

* * * * *